US006591574B2

(12) United States Patent
Humphrey

(10) Patent No.: US 6,591,574 B2
(45) Date of Patent: Jul. 15, 2003

(54) BRACKET ASSEMBLY FOR INSTALLATION OF CONCRETE FORMS FOR BUILDING FOUNDATIONS

(76) Inventor: Troy L. Humphrey, 313 NE. 4th, Canby, OR (US) 97013

( * ) Notice: Subject to any disclaimer, the term of this patent is extended or adjusted under 35 U.S.C. 154(b) by 0 days.

(21) Appl. No.: 09/925,900

(22) Filed: Aug. 9, 2001

(65) Prior Publication Data

US 2003/0029130 A1 Feb. 13, 2003

(51) Int. Cl.[7] ..... E04C 5/16

(52) U.S. Cl. ..... 52/678; 52/677; 248/200.1; 248/298.1

(58) Field of Search ..... 52/677, 678; 248/200.1, 248/298.1, 295.11, 906, 243

(56) References Cited

U.S. PATENT DOCUMENTS

| | | | | |
|---|---|---|---|---|
| 874,151 A | | 12/1907 | Zeiser | |
| 2,378,850 A | | 6/1945 | Hyre | |
| 3,778,020 A | | 12/1973 | Burrows et al. | |
| 4,029,288 A | | 6/1977 | Murphy et al. | |
| 4,339,106 A | | 7/1982 | Navarro | |
| 4,678,156 A | | 7/1987 | Scalamandre et al. | |
| 5,044,582 A | * | 9/1991 | Walters | 248/200.1 |
| 5,048,781 A | | 9/1991 | Breen | |
| 5,060,892 A | * | 10/1991 | Dougherty | 248/200.1 |
| 5,156,753 A | | 10/1992 | Speidel | |
| 5,873,556 A | * | 2/1999 | Reiker | 248/906 |

* cited by examiner

*Primary Examiner*—Carl D. Friedman
*Assistant Examiner*—Nahid Amiri
(74) *Attorney, Agent, or Firm*—Kolisch Hartwell, P.C.

(57) ABSTRACT

A bracket assembly for installation of concrete forms for building foundations is disclosed which includes an elongate bar structure having opposed ends for mounting on the upper portions of vertically positioned concrete forms. The bracket assembly is provided to preselect and maintain the lateral spacing between the forms, and includes an adjustable rebar guide, shiftable along the length of the elongate bar structure for clamping rebar in a selected vertical position. The adjustable rebar guide includes a first clamping element, such as a bolt, which is operable to engage the elongate bar structure to fix the rebar guide at a selected location thereon. The adjustable rebar guide also includes a walled bracket for mounting a second clamping element which clamps rebar against the rebar guide in a selected vertical position.

10 Claims, 2 Drawing Sheets

BRACKET ASSEMBLY FOR INSTALLATION OF CONCRETE FORMS FOR BUILDING FOUNDATIONS

BACKGROUND OF THE INVENTION

The present invention relates to building construction and installation of concrete forms for buildings, and more particularly to a novel bracket assembly for mounting on the forms to preselect and maintain the lateral distance or spacing between them. In preparing a building site for pouring of concrete for the foundation, a trench generally is excavated, in the outline of the building, and wooden concrete forms, often 2×10-foot boards, are arranged upright and spaced laterally to preselect the width and depth of the foundation. There have been various proposals for preselecting or fixing the distance between concrete forms, and maintaining them rigidly positioned during pouring of concrete. After concrete has been poured and has set-up sufficiently, the forms are dismantled, and building of the structure proceeds.

Different methods have been used for preselecting the lateral spacing between concrete forms. One example is set forth in U.S. Pat. No. 4,029,288 which discloses a concrete form bracket having bracket halves, generally L-shaped in form, which include legs and a flange for mounting above the upper portion of a wall form, and wherein a plurality of wedge pins are used to mount the two halves together. In another embodiment shown in the patent, a continuous U-shaped bracket is shown which supports wall forms spaced-apart from one another and which includes downwardly depending flanges set at an angle for engaging opposite end portions of the vertically-positioned wall forms.

In U.S. Pat. No. 2,378,850 there is shown a so-called form aligner in which a plate has mounted on opposite ends thereof vertically spaced-apart walls which accept the bottom end of vertically-positioned form members. The form aligner includes a sliding member through which may be extended a dowel pin which has been previously cast in a prior-poured footing. The slider element enables the aligner to be positioned so that it holds the wall forms in a desired location. There is no disclosure in U.S. Pat. No. 2,378,850 for positioning or preselecting location of rebar material.

In U.S. Pat. No. 4,339,106, there is disclosed a reusable bracket assembly for concrete forms in which a pair of U-shaped brackets each include tubular members, one slidable within the other and fixed relative to one another by an adjustable set screw so that the lateral spacing between vertical uprights can be preselected. The vertical uprights each include relatively thin members provided with plates extending therefrom for holding wooden form members. The plates are provided with a plurality of holes through which nails can be driven into the wooden form members. Another example of a concrete form, stated to be reusable, is the spacer/tie rod assembly shown in U.S. Pat. No. 4,678,156. In that patent, a tie rod assembly interconnects spaced-apart plywood sheets. The tie rod assembly includes downwardly and upwardly turned opposite ends for tying the assembly together.

Still another example of a foundation device for use in concrete molding is disclosed in U.S. Pat. No. 3,778,020, wherein a plate is provide with spaced-apart vertical walls at opposite ends thereof. The vertically spaced-apart walls are dimensioned for receiving bottom ends of concrete forms and the plate is suitably attached by a fastener to a preexisting foundation. After the concrete wall is poured, between the forms, the plate remains in position and becomes part of the structure.

Another type of bracket for preselecting lateral spacing between concrete forms is a product sold under the name "Rebar Buddy," which is made of plastic material and includes a mount for positioning rebar in a selected one of several positions. However, only the selected positions can be used for vertically mounting the rebar, and they are not adjustable to other desired positions.

SUMMARY OF THE INVENTION

The present invention is directed to a reusable bracket assembly for use in installing and predetermining the lateral spacing between concrete forms (usually made of wood) which are set vertically on the ground prior to concrete pouring. The bracket assembly also includes an adjustable rebar guide for prepositioning rebar, which is to be set vertically, prior to concrete pouring between the wall forms. The bracket assembly includes first and second elongate members which are longitudinally shiftable relative to one another and which include an end for engaging an upper portion of a concrete form. An adjustable retainer for releasably connecting the first and second elongate members is provided so that they may be shifted relative to one another to space them apart a preselected distance, which will correspond to the width of a foundation to be poured.

A unique feature of the present invention is the adjustable rebar guide mounted on one of the elongate members to hold a section of rebar substantially vertical for holding the rebar in position during concrete pouring. The rebar mount is laterally shiftable along one of the elongate members (prior to pouring) to a selected position, where it may be fixed for preselecting position of the rebar.

The bracket assembly of the present invention utilizes an adjustable retainer which is of simple construction. One of the elongate members is provided with a plurality of spaced-apart apertures, through which a pin may be inserted in an aligned aperture in the other elongate member to preselect lateral spacing between ends of the elongate members, depending upon the lateral spacing desired between the concrete forms. The adjustable rebar guide is formed as a member which can be slidably positioned or shifted along one of the elongate members, to a preselected location therealong, and fixed thereto. A clamping member, such as a bolt, pin or the like is then used to clamp the rebar, in a selected vertical position, relative to the ground. The clamping member may be released so that the rebar may be vertically shifted to a desired location.

DETAILED DESCRIPTION OF THE PREFERRED EMBODIMENT AND BEST MODE OF CARRYING OUT THE INVENTION

Figure 1:
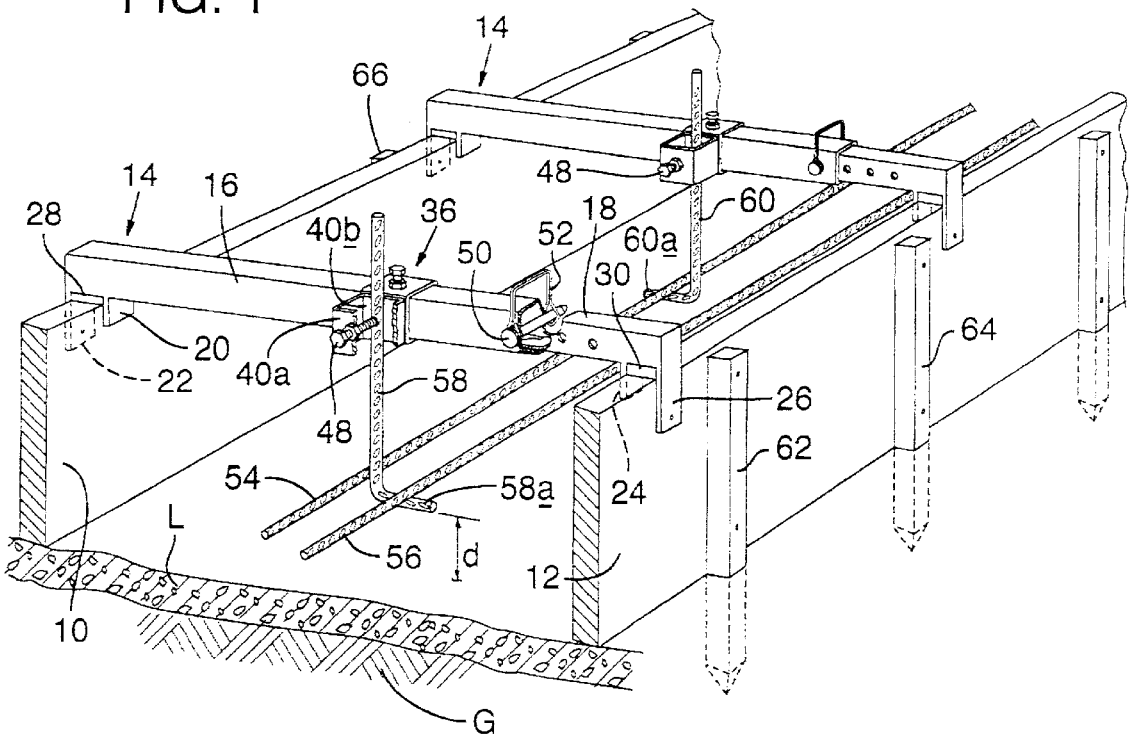
FIG. 1 is a perspective view, showing vertically-positioned concrete wall forms, held in position by two of the bracket assemblies of the present invention.

When it is desired to pour a concrete foundation, it is necessary for a concrete contractor first to cut a trench in the ground along the outline of where the concrete foundation will be poured. Depending upon the size of the building, and its necessary foundation, a trench may be cut several feet beneath the ground and dug to a width of several feet, say five feet, for a typical building. The trench is always wider than the width of the foundation to be poured, to leave workers room to place concrete forms, which are wood, and which are placed vertically in the trench a predetermined distance apart. In a typical trench, such as shown in FIG. 1, a gravel layer L has been spread over the ground, indicated at G, prior to positioning of concrete forms. Initially, workers position wooden concrete forms, such as indicated at 10 and 12 so that they are vertically positioned and laterally spaced apart, as shown in FIG. 1. The concrete forms extend along a given length (the view in FIG. 1 is broken along its length) and the workers initially eyeball the forms in position, prior to accurately preselecting their width using bracket assembly 14 of the present invention. Prior to a description of how bracket assembly 14 is used to preselect the lateral spacing, and to maintain that spacing between forms 10 and 12, details of the bracket assembly will be set forth, with reference to FIG. 2.

As shown, bracket assembly 14 is formed as an elongate bar structure and includes a first elongate member 16 of tubular form, and a second elongate member 18, also tubular in form. The first and second elongate members may be made of any suitable material, such as steel, iron, rigid plastic, etc. The cross-sectional area of first elongate member 16 is a square (it could be circular), and is greater than that of second elongate member 18, so that the latter may slidably received within the former. Each of the elongate members is provided with flanged ends for engaging or overlapping an upper portion of a concrete form. Specifically, first elongate member 16 includes spaced-apart flanges 20 and 22 and second elongate member 18 includes spaced-apart flanges 24 and 26. Spacers, such as indicated at 28 and 30 are positioned between flanges 20, 22 and 24, 26, respectively so that the bottom of the spacers will contact the top of a respective concrete form when installed, as will be described.

Figure 2:
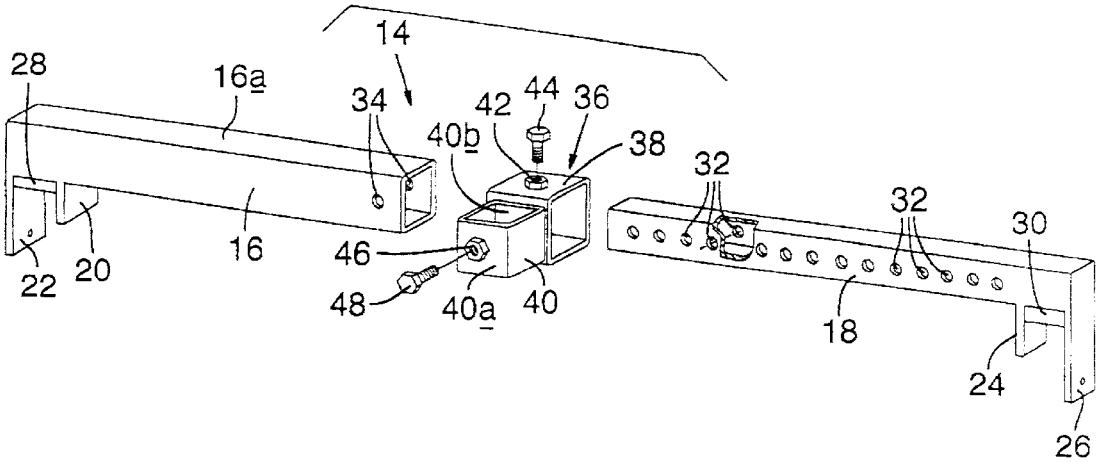
FIG. 2 is an exploded view of one of the bracket assemblies, showing the arrangement of a rebar mount and its orientation relative to first and second elongate members of the bracket assembly.

It will also be seen in FIG. 2 that second elongate member 18 is provided with a plurality of through apertures, such as indicated at 32, it being understood that the apertures extend from one wall and are aligned with an aperture in the corresponding opposite wall of second elongate member 18. A pair of aligned apertures is indicated at 34 in the opposed walls of first elongate member 16, and these apertures may be aligned with a selected one of the apertures 32 in the second elongate member to preselect the spacing between the flanges, such as flanges 22 and 26. That spacing will correspond to the lateral spacing desired between the outer walls of concrete forms 10 and 12. The distance between apertures 32 and second elongate member 18 have been found in practice to be in the range of 1–2 inches to provide sufficient choices for laterally spacing concrete forms.

Shown in the center of FIG. 2 is an adjustable rebar guide, generally indicated at 36, which includes a tubular sleeve 38 from which extends a walled bracket 40. Sleeve 38 is formed to at least partially encircle one of the elongate members, such as elongate member 16. An upper wall of sleeve 38 is provided with an aperture extending therethrough to which a nut 42 is secured and aligned for receiving a first clamping element such as a bolt 44. The bolt is dimensioned with a length and is operable so that when it is rotated inwardly, an end of the bolt will engage top wall 16*a* of first elongate member 16 (when the components are assembled) so that it can be rigidly clamped thereto, and fix rebar guide 36 at a selected location on that elongate member. Bracket 40 also includes an aperture extending through its front wall 40*a* to which a nut 46 is aligned, as by welding, for mounting a second clamping element such as a bolt 48 for threaded insertion through nut 46 to clamp rebar in a selected vertical position, as will be explained with reference to FIG. 1.

Installation of the Bracket Assembly

A description of the use of bracket assembly 14 for installation of concrete forms for building foundations will proceed with reference to FIG. 1. The concrete contractor knows from the plans and specifications the width of the foundation, and workers position concrete forms 10 and 12 (which typically are wooden 2×10's) in their approximate location, positioned upright on edge, as shown. Bracket assembly 14, and other bracket assemblies which are to be spaced-apart in an array along the length of the wall, are preset so that the spacing between outer flanges 22 and 26 match the outer dimension of the concrete forms. (See FIG. 3 also.) That preselected spacing is accomplished by relative longitudinal shifting of the first and second elongate members relative to one another until apertures 34 of the first elongate member are suitably aligned with the proper apertures 32 of the second elongate member. At that position, a retainer such as a pin 50, is suitably inserted in the aligned apertures and a bail, such as indicated at 52, is positioned with its loop encircling a distal end of the pin, as shown in FIG. 1, so that the first and second elongate members are secured to one another.

At this point, no rebar has been placed, and workers then adjust concrete forms 10 and 12 and install the bracket assemblies, such as indicated at 14 in FIG. 1, so that the upper portions of the concrete forms are positioned upwardly within associated flanges, such as flanges 20, 22 and 24, 26. With the bracket assembly so mounted, so that spacers 28 and 30 are oriented with their bottom edges engaging the top edges of the concrete forms, those forms are now laterally-spaced apart the proper distance, and are maintained with that spacing. Workers then continuously install the required number of the bracket assemblies down the line of the concrete forms, as shown in FIG. 1, a preselected distance apart, in the range of 18 inches or whatever has been specified for a particular job. Most foundations are specified to include rebar, horizontally positioned and supported above the ground by vertical rebar members. Horizontal reinforcing bars are shown at 54 and 56, and they are dimensioned to extend a given distance. The horizontal rebar members are held in position by vertical rebar indicated at 58 and 60, each of which includes a foot or "tail," such as indicated at 58*a*, 60*a*, which extend horizontally from vertical rebar sections 58 and 60, respectively. Of course, in a given job, many bracket assemblies will be mounted, and long stretches of horizontal rebar will be supported.

Figure 3:
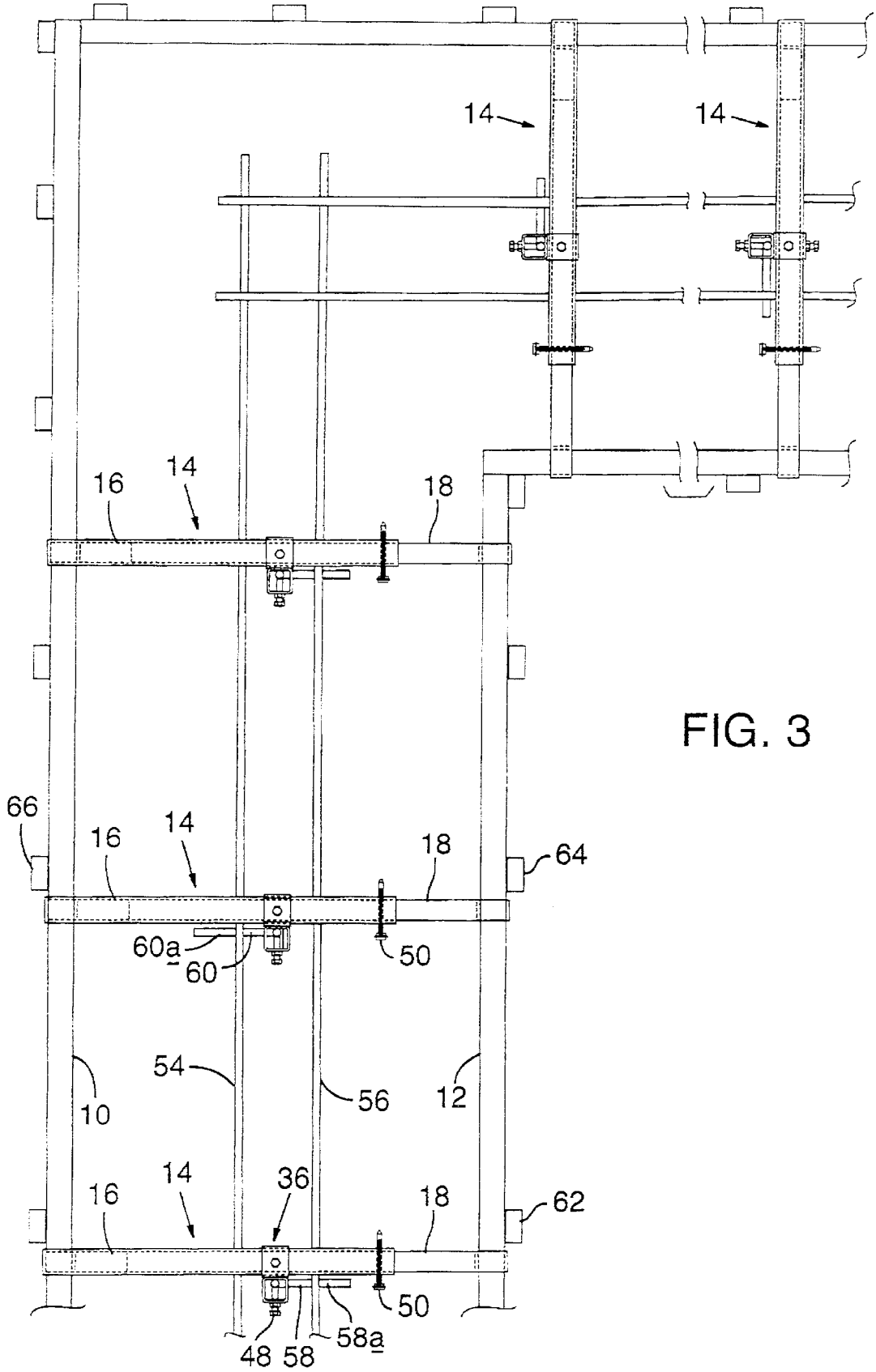
FIG. 3 is a top plan view showing an array of bracket assemblies arranged on concrete forms extending along two regions which join at a foundation wall corner.

The positioning of vertical rebars 58 and 60 is accomplished by the novel adjustable rebar guide of the present invention, such as indicated at 36. Rebar guide 36, assuming that bolt 44 has been suitably loosened, may be positioned along first elongate member 16 to a desired location, either in the middle of the span between the concrete forms or at some other preselected location as specified by the job plans. As shown in FIG. 1, tails 58*a* and 60*a* are positioned to face in directions 180° apart, so that rebar 54 and 56 may be spaced apart, in elongate rows and positioned side by side. While FIG. 1 shows tail 58*a* directed to the right, and tail 60*a* directed to the left, it will be understood that this alternate pattern will progress down the line of the mounted bracket assemblies, however many are installed, as shown in FIG. 3. Another consideration is that the tails must be positioned a certain distance d above the ground or gravel, for example, in the range of 3 inches or thereabouts.

Once the contractor has determined the positioning of where the vertical rebar is to be located, and rebar guide 36 has been fixed to that location, and assuming bolt 48 has been retracted, the vertical rebar may be put into position, turned to orient its tail, such as tail 58*a* or 60*a*, to its proper position. Bolt 48, being horizontally mounted, is then tightened to clamp the rebar against an inner wall of walled bracket 40, such as wall 40*b* as shown in FIG. 1. FIG. 1 also shows wall 40*a* broken away so that the clamping action of the end of bolt 48 against vertical rebar 58 can be seen. The rebar guide is therefore manually operable not only for laterally shifting to place rebar in a selected position but also for securely holding or fixing the rebar substantially vertically a preselected distance above the ground or gravel, as the case may be.

Once all of the bracket assemblies have been positioned, and the vertical rebar has been suitably mounted and oriented, then elongate rebar, such as 54 and 56 are laid down on the "tails." When a given section of the concrete forms have been so installed, workers drive stakes, such as indicated at 62, 64, etc. into the ground and nail them into an associated one of the concrete forms. The next step requires that the contractor "shoot the elevation," which refers to adjusting the height of the concrete forms so that their upper edges are level or raised to a predetermined, specified elevation. That is done using a builder's level or laser system and depending on the need, forms are pried or raised to a desired level. When this is all completed, the concrete may be poured, so that it fills the volume between the concrete forms and reaches the top edge of the forms.

Because the spacers, such as indicated at 28 and 30 are provided, the bottom edge of the bracket assembly does not contact the top of the poured concrete, nor does the bottom edge or portions of rebar guide 36. Thus, after the concrete has sufficiently set up, the clamping bolts, such as indicated at 48, may be suitably backed off or loosened, and the bracket assemblies may be dismantled from the forms by lifting them upwardly, over the top of the vertical rebars so that the bracket assemblies are fully detached.

From the above, it can be seen that the present invention provides a simple construction for installing and predetermining the lateral spacing between concrete forms which have been set or pre-positioned vertically on the ground, and additionally for pre-positioning rebar prior to concrete pouring. The provision of first and second elongate members, such as indicated 16, 18, and the retainer system for releasably connecting these members, makes adjustment quick and easy. The provision of an adjustable rebar guide, such as indicated at 36, enables vertical rebar to be preset at a desired location—only the tightening of bolts 44 and 48 is required. And, release of the bracket assembly from vertical rebar, after pouring has been accomplished, is quickly accomplished by loosening the clamping mechanism, such as bolt 48. Moreover, if desired, the components of the bracket assembly may be disassembled and cleaned, an important feature when it is recognized that installing concrete forms takes place on the ground, and concrete pouring can inevitably lead to spillage.

I claim:

1. A bracket assembly for use in installing and predetermining the lateral spacing between concrete forms set vertically on the ground and prepositioning rebar prior to concrete pouring between the forms, the bracket assembly comprising:

first and second elongate members longitudinally shiftable relative to one another, each including an end for engaging an upper portion of a concrete form;

an adjustable retainer for releasably connecting the first and second elongate members so that their ends are spaced-apart a preselected distance; and an adjustable rebar guide laterally shiftable relative to the elongate members for holding rebar substantially vertical, wherein the adjustable rebar guide is provided with a first clamping element operable for fixing the rebar guide at a selected location on one of the elongate members, and the adjustable rebar guide includes a second clamping element operable for clamping rebar in a selected vertical position against the adjustable rebar guide.

2. The bracket assembly of claim 1, wherein the second clamping element includes a bolt member horizontally mounted on the rebar guide and movable inwardly to clamp rebar against the rebar guide.

3. The bracket assembly of claim 2, wherein the first clamping element includes a bolt member for selectively engaging one of the elongate members to position the rebar guide at a selected location on one of the elongate members.

4. The bracket assembly of claim 3, wherein the rebar guide is configured as a sleeve at least partially encircling one of the elongate members.

5. The bracket assembly of claim 4, wherein the rebar guide includes a walled bracket extending from the sleeve for mounting the second clamping element.

6. A bracket assembly for use in installing and predetermining the lateral spacing between concrete forms set vertically on the ground and prepositioning rebar prior to concrete pouring between the forms, the bracket assembly comprising:

an elongate bar structure including opposed ends, each for engaging an upper portion of an associated concrete form; and an adjustable rebar guide laterally shiftable relative to the elongate bar structure for holding rebar substantially vertical, wherein the adjustable rebar guide is provided with a first clamping element operable for fixing the rebar guide at a selected location on the elongate bar structure, and wherein the adjustable rebar guide includes a second clamping element operable for clamping rebar in a selected vertical position against the adjustable rebar guide.

7. The bracket assembly of claim 6 wherein the second clamping element includes a bolt member horizontally mounted on the rebar guide and movable inwardly to clamp rebar against the rebar guide.

8. The bracket assembly of claim 7 wherein the first clamping element includes a bolt member for selectively engaging the elongate bar structure to position the rebar guide at a selected location on the elongate bar structure.

9. The bracket assembly of claim 8 wherein the rebar guide includes a sleeve at least partially encircling the elongate bar structure.

10. The bracket assembly of claim 9 wherein the rebar guide includes a walled bracket extending from the sleeve for mounting the second clamping element.

* * * * *